US008026893B2

(12) United States Patent
Hong et al.

(10) Patent No.: US 8,026,893 B2
(45) **Date of Patent: *Sep. 27, 2011**

(54) LIQUID CRYSTAL DISPLAY DEVICE AND APPARATUS AND METHOD FOR DRIVING THE SAME

(75) Inventors: Hee Jung Hong, Seoul (KR); Kyung Joon Kwon, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1273 days.

This patent is subject to a terminal disclaimer.

(21) Appl. No.: 11/647,261

(22) Filed: Dec. 29, 2006

(65) Prior Publication Data

US 2007/0152953 A1 Jul. 5, 2007

(30) Foreign Application Priority Data

Dec. 29, 2005 (KR) ..... 10-2005-0134411

(51) Int. Cl.
*G09G 3/36* (2006.01)

(52) U.S. Cl. ..... 345/102; 362/225; 362/555; 362/561

(58) Field of Classification Search ..... 345/102; 362/225, 555, 561
See application file for complete search history.

(56) References Cited

U.S. PATENT DOCUMENTS

| | | | | |
|---|---|---|---|---|
| 7,355,611 | B2 * | 4/2008 | Bianchi et al. | 345/690 |
| 2002/0149576 | A1 * | 10/2002 | Tanaka et al. | 345/204 |
| 2004/0222999 | A1 * | 11/2004 | Choi et al. | 345/589 |
| 2004/0264212 | A1 | 12/2004 | Chung et al. | |
| 2005/0140614 | A1 * | 6/2005 | Baek | 345/87 |
| 2005/0141217 | A1 | 6/2005 | Kim | |
| 2006/0146351 | A1 * | 7/2006 | Lo et al. | 358/1.9 |
| 2006/0284805 | A1 * | 12/2006 | Baek | 345/88 |

FOREIGN PATENT DOCUMENTS

| | | | |
|---|---|---|---|
| CN | 1551707 | A | 12/2004 |
| CN | 1693968 | A | 11/2005 |

* cited by examiner

*Primary Examiner* — Kevin M Nguyen
*Assistant Examiner* — Michael Pervan
(74) *Attorney, Agent, or Firm* — Morgan, Lewis & Bockius LLP

(57) ABSTRACT

A liquid crystal display device includes a liquid crystal display panel with four colors of sub-pixels, and a backlight unit having light emitting diodes of at least five colors to apply multi-primary light to the liquid crystal display panel.

4 Claims, 8 Drawing Sheets

FIG. 1
Related Art

| | | | | | | | | | | | | | | | | | |
|---|---|---|---|---|---|---|---|---|---|---|---|---|---|---|---|---|---|
| R | G | B | R | G | B | R | G | B | R | G | B | R | G | B | R | G | B |
| R | G | B | R | G | B | R | G | B | R | G | B | R | G | B | R | G | B |
| R | G | B | R | G | B | R | G | B | R | G | B | R | G | B | R | G | B |
| R | G | B | R | G | B | R | G | B | R | G | B | R | G | B | R | G | B |

FIG. 2
Related Art

| | | | | | | | | | | | | | | | |
|---|---|---|---|---|---|---|---|---|---|---|---|---|---|---|---|
| R | G | B | W | R | G | B | W | R | G | B | W | R | G | B | W |
| R | G | B | W | R | G | B | W | R | G | B | W | R | G | B | W |
| R | G | B | W | R | G | B | W | R | G | B | W | R | G | B | W |
| R | G | B | W | R | G | B | W | R | G | B | W | R | G | B | W |

FIG. 3
Related Art

| | | | | | | | | | | | | | | | |
|---|---|---|---|---|---|---|---|---|---|---|---|---|---|---|---|
| R | G | R | G | R | G | R | G | R | G | R | G | R | G | R | G |
| B | W | B | W | B | W | B | W | B | W | B | W | B | W | B | W |
| R | G | R | G | R | G | R | G | R | G | R | G | R | G | R | G |
| B | W | B | W | B | W | B | W | B | W | B | W | B | W | B | W |
| R | G | R | G | R | G | R | G | R | G | R | G | R | G | R | G |
| B | W | B | W | B | W | B | W | B | W | B | W | B | W | B | W |
| R | G | R | G | R | G | R | G | R | G | R | G | R | G | R | G |
| B | W | B | W | B | W | B | W | B | W | B | W | B | W | B | W |
| R | G | R | G | R | G | R | G | R | G | R | G | R | G | R | G |
| B | W | B | W | B | W | B | W | B | W | B | W | B | W | B | W |

LIQUID CRYSTAL DISPLAY DEVICE AND APPARATUS AND METHOD FOR DRIVING THE SAME

This application claims the benefit of the Korean Patent Application No. P2005-134411, filed on Dec. 29, 2005, which is hereby incorporated by reference in its entirety.

BACKGROUND OF THE INVENTION

1. Field of the Invention

Embodiments of the invention relate to a display device, and more particularly, to a liquid crystal display (LCD) device and an apparatus and method for driving the same. Although embodiments of the invention are suitable for a wide scope of applications, it is particularly suitable for an improved color-realization ratio.

2. Discussion of the Related Art

Generally, an LCD device displays an image on an LCD panel by controlling transmittance of light provided from a backlight unit. The LCD panel is provided with a plurality of liquid crystal cells arranged in a matrix configuration. A plurality of control switches are provided in the liquid crystal cells to switch video signals supplied to the liquid crystal cells.

The liquid crystal cells each include a liquid crystal layer in which an electric field is formed in accordance with a data signal. A desired image is displayed by controlling the transmittance of light passing through the liquid crystal layers of the liquid crystal cells. The application of different electric fields correspondingly determines the different levels of light transmittances through a liquid crystal layer. However, a deterioration may occur in that subsequent applications of an electric field to the liquid crystal layer may not provide the appropriately corresponding light transmittance level due to charge build-up in the liquid crystal layer. To prevent such a deterioration, the polarity of data signal is inverted each frame, line, or dot.

FIG. 1 illustrates a stripe-type arrangement of RGB sub-pixels in a related art LCD device. As shown in FIG. 1, a related art LCD device includes an LCD panel having pixels arranged in a matrix configuration, wherein each of the pixels has color dots of red(R), green(G) and blue(B). The LCD device displays a color image by mixing red, green and blue light from the respective dots. The related art LCD device requires a backlight unit to provide light to the LCD panel.

The trend in backlight units is toward smaller size, thinner profile, and lighter weight. Based on this trend, light emitting diodes (LEDs) are being used instead of fluorescent lamps since LEDs have lower power consumption, lighter weight, and high brightness. A backlight unit using LEDs generates white light by mixing the red(R), green(G) and blue(B) light that are respectively generated from red(R), green(G) and blue(B) LEDs.

In the related art LCD device of FIG. 1, a unit pixel is provided with red(R), green(G) and blue(B) dots that may have a problem of low light-efficiency. More specifically, color filters arranged in the respective sub-pixels of red(R), green(G) and blue(B) colors transmits only a third (⅓) of the applied light, which lowers overall brightness. Accordingly, a RGBW-type LCD device has been proposed, which includes one unit pixel provided with four color dots of red(R), green (G), blue(B) and white(W) colors.

FIG. 2 illustrates a stripe-type arrangement of RGBW sub-pixels in a related art LCD device. As shown in FIG. 2, the RGBW-type LCD device has four colors of dots arranged in a stripe shape. In the alternative, the four colors of dots can be arranged in other configurations. FIG. 3 illustrates a quad-type arrangement of RGBW sub-pixels in a related art LCD device. As shown in FIG. 3, the RGBW-type LCD device has four colors of dots arranged in a quad shape.

In an RGBW-type LCD device, red, green and blue color filters are respectively formed in the red, green and blue dots while the white dot does not have any color filter. White light generated by a backlight unit using a fluorescent lamp passes through the white color dot. Thus, the RGBW-type LCD device improves brightness by mixing the white light passing through the white dot with the light from the red, green and blue dots.

The RGBW-type LCD device is not used in combination with a backlight unit using red(R), green(G) and blue(B) LEDs. Because of the use of red, green and blue dots with red, green and blue LEDs, the color realization ratio is low. Further, contrast can be low by using red, green and blue dots with red, green and blue LEDs.

SUMMARY OF THE INVENTION

Accordingly, the present invention is directed to an LCD device and an apparatus and method for driving the same, which substantially obviates one or more problems due to limitations and disadvantages of the related art.

An object of embodiments of the invention is to provide an LCD device and an apparatus and method for driving the same to improve the color-realization ratio.

Another object of embodiments of the invention is to provide an LCD device and an apparatus and method for driving the same to improve contrast.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a liquid crystal display device includes a liquid crystal display panel with four colors of sub-pixels, and a backlight unit having light emitting diodes of at least five colors to apply multi-primary light to the liquid crystal display panel.

In another aspect, a liquid crystal display device includes a liquid crystal display panel with red, green, blue and white sub-pixels, and a backlight unit having red, green, and blue, and at least two other colors of light emitting diodes for applying light to the liquid crystal display panel, wherein light from the red, green and blue light emitting diodes can mix into white light.

In another aspect, an apparatus for driving a liquid crystal display device having four colors of sub-pixels includes a data converter that converts input data of three colors inputted externally into four-color data, a data driver that converts the four-color data into video signals and then supplies the video signals to the sub-pixels, a gate driver that supplies a scan pulse to each sub-pixel, a timing controller that arranges the four-color data supplied from the data converter, and then supplies the arranged four-color data to the data driver while controlling the data driver and the gate driver, a backlight unit that provides light to the liquid crystal display panel using at least five colors of light emitting diodes, and a light emitting diode controller that controls the backlight unit in accordance with the three-color input data.

In another aspect, a method for driving a liquid crystal display device having a light emitting diode panel provided with four colors of sub-pixels includes converting input data of three colors inputted externally into four-color data, supplying a scan pulse to each sub-pixel, converting the four-color data into video signals, and then supplying the video signals to the sub-pixels in synchronization with the scan pulse, and driving a backlight unit having light emitting diodes of at least five colors to provide light to the liquid crystal display panel.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention. In the drawings:

FIG. 1 illustrates a stripe-type arrangement of RGB sub-pixels in a related art LCD device;

FIG. 2 illustrates a stripe-type arrangement of RGBW sub-pixels in a related art LCD device;

FIG. 3 illustrates a quad-type arrangement of RGBW sub-pixels in a related art LCD device;

DETAILED DESCRIPTION OF THE INVENTION

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. Wherever possible, the same reference numbers will be used throughout the drawings to refer to the same or like parts.

Figure 4:
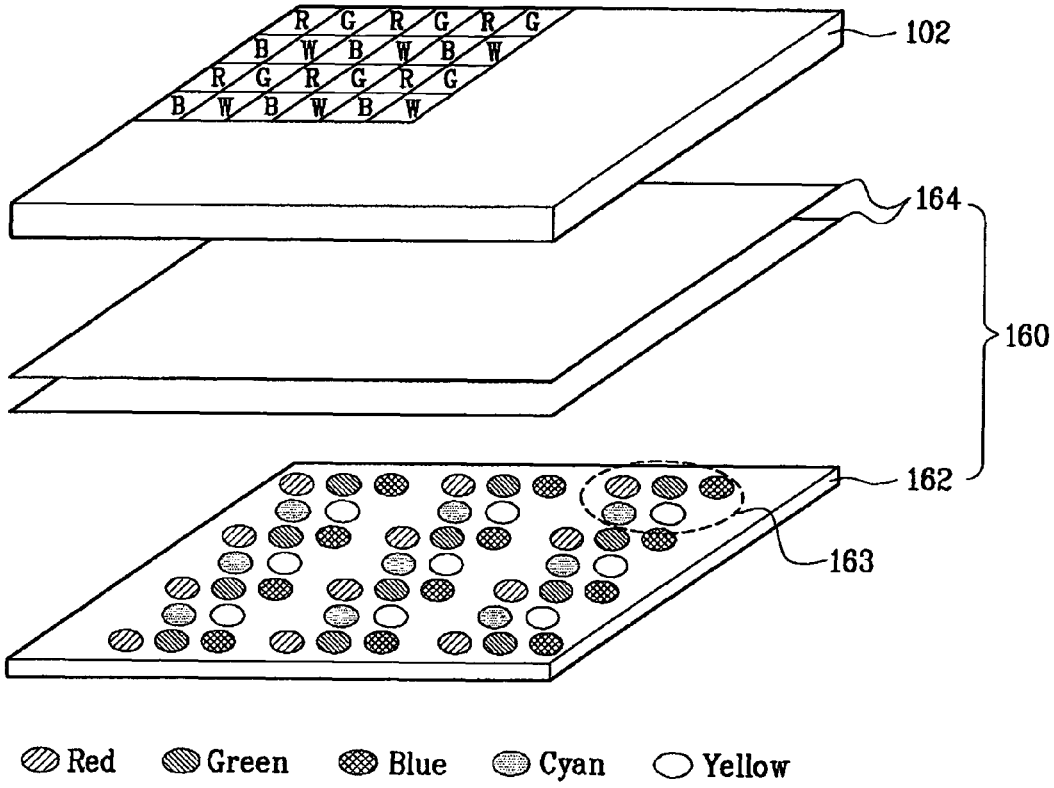
FIG. 4 is a perspective view of an LCD device according to the first embodiment of the invention.

FIG. 4 is a perspective view of illustrating an LCD device according to the first embodiment of the invention. As shown in FIG. 4, the LCD device according to the first embodiment of the invention includes an LCD panel 102 having four colors of sub-pixels and a backlight unit 106 that applies light to the LCD panel 102 using five colors of light emitting diodes (LEDs). More specifically, the LCD panel 102 includes red(R), green(G), blue(B), and white(W) sub-pixels arranged in a matrix configuration. The red(R), green(G), and blue(B) sub-pixels have corresponding color filters. The white(W) sub-pixel does have any color filter.

The respective sub-pixels can be the same size or have different sizes. For example, the white(W) sub-pixel can be smaller than the red(R), green(G), and blue(B) sub-pixels. The sub-pixels can be configured in a stripe-type shape or quad-type arrangement.

The backlight unit 160 includes an LED array 162 having a plurality of LED groups 163. Each of the LED groups 163 is provided with at least five colors of LEDs. The plurality of LED groups 163 are arranged on a printed circuit board (PCB) in a matrix configuration to thereby uniformly provide light to the entire rear surface of the LCD panel 102. Each of the plurality of LED groups 163 are provided with a red LED that emits a red light, a green LED that emits a green light; a blue LED that emits a blue light; a cyan LED that emits a cyan light; and a yellow LED that emits a yellow light.

A plurality of optical sheets 164 are arranged over the LED array 162 to improve the brightness and consistency of the light provided to the LCD panel 102. The plurality of optical sheets 164 include at least one diffusion sheet (or diffusion plate) that diffuses the incident light from the LED array 162. Further, the plurality of optical sheets 164 can include at least one prism sheet that changes the path of light diffused in the diffusion sheet toward the LCD panel 102 to improve the efficiency of light.

In the LCD device according to the first embodiment of the invention, white light is formed by mixing red light, green light and blue light, while cyan light, and yellow light are also applied to the LCD panel 102. The red light, green light, blue light, cyan light and yellow light respectively come from red, green, blue, cyan, and yellow LEDs. The light from the cyan and yellow LEDs are used to improve color realization ratio by using multi-primary light.

Figure 5:
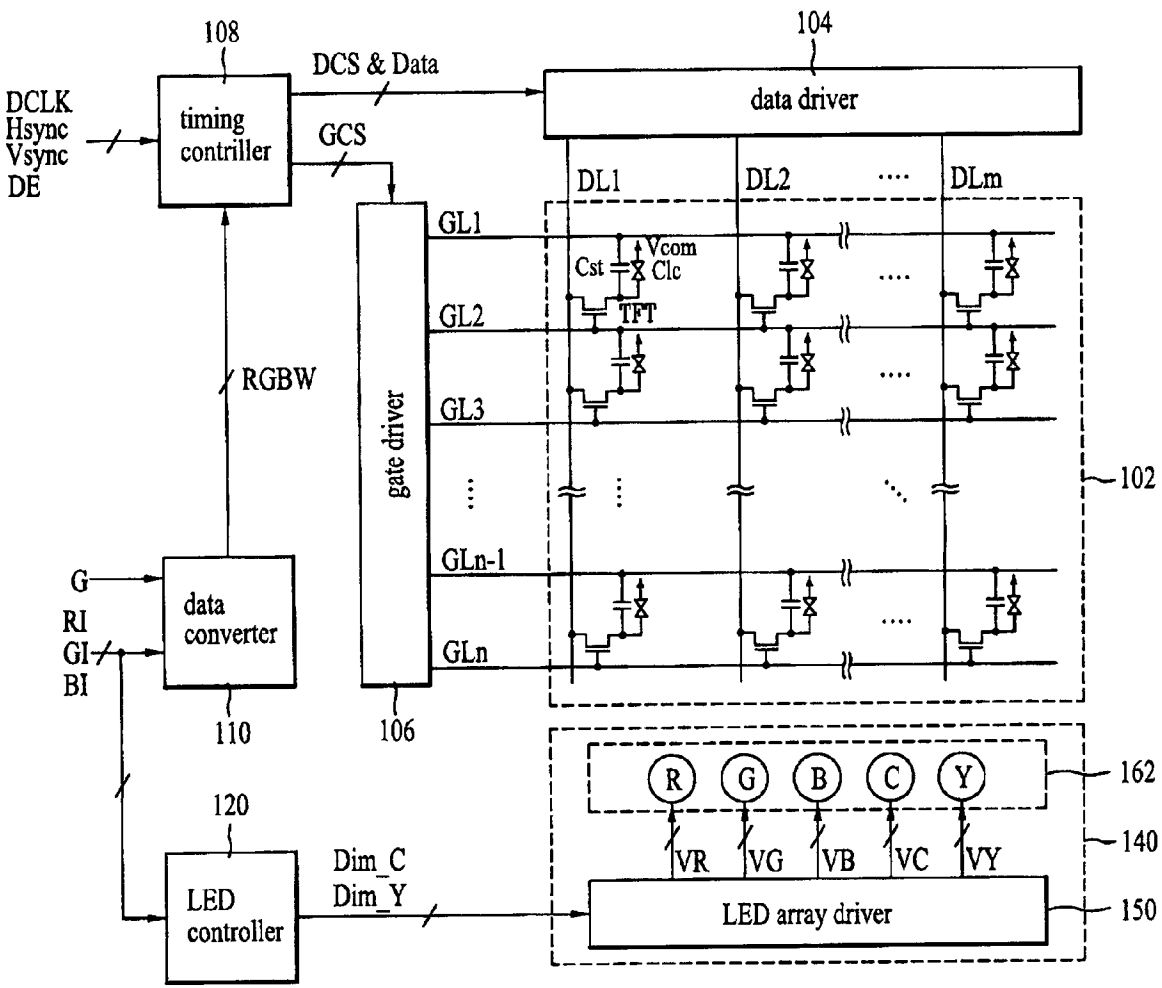
FIG. 5 is a schematic view of illustrating an LCD device and a driving apparatus thereof according to the first embodiment of the invention.

FIG. 5 is a schematic view of illustrating an LCD device and a driving apparatus thereof according to the first embodiment of the invention. Referring to FIG. 5 in association with FIG. 4, the LCD device and the driving apparatus according to the first embodiment of the invention includes: an LCD panel 102 having liquid crystal cells formed in respective sub-pixels of four colors defined by n gate lines (GL1 to GLn) and m data lines (DL1 to DLm); a data driver 104 that supplies a video signal to the data lines (DL1 to DLm); a gate driver 106 that supplies a scan pulse to the gate lines (GL1 to GLn); a data converter 110 that converts input data of three colors (RI, GI, BI) to input data of four colors (RGBW); a timing controller 108 that arranges the input data of four colors (RGBW) and supplies the arranged data to the data driver 104, controls the data driver 104 by generating a data control signal (DCS), and controls the gate driver 106 by generating a gate control signal (GCS); an LED backlight unit 140 have five colors of LEDs; and an LED controller 120 that controls the LED backlight unit 140 in accordance with the input data of three colors (RI, GI, BI).

The LCD panel 102 also includes a plurality of thin film transistors (TFT) that are formed in the respective regions defined by the n gate lines (GL1 to GLn) and the m data lines (DL1 to DLm). The plurality of thin film transistors (TFT) are connected to the liquid crystal cells. Each TFT supplies the data signal provided from the data line (DL1 to DLm) to a liquid crystal cell in response to the scan pulse provided from the gate line (GL1 to GLn). Each liquid crystal cell can be equivalently expressed as a liquid crystal capacitor (Clc) because it is provided with a common electrode facing a sub-pixel electrode, connected with the TFT, across a liquid crystal layer. Also, the liquid crystal cell includes a storage capacitor (Cst) that maintains the data signal charged on the liquid crystal capacitor (Clc) until the next data signal is charged thereon.

Figure 6:
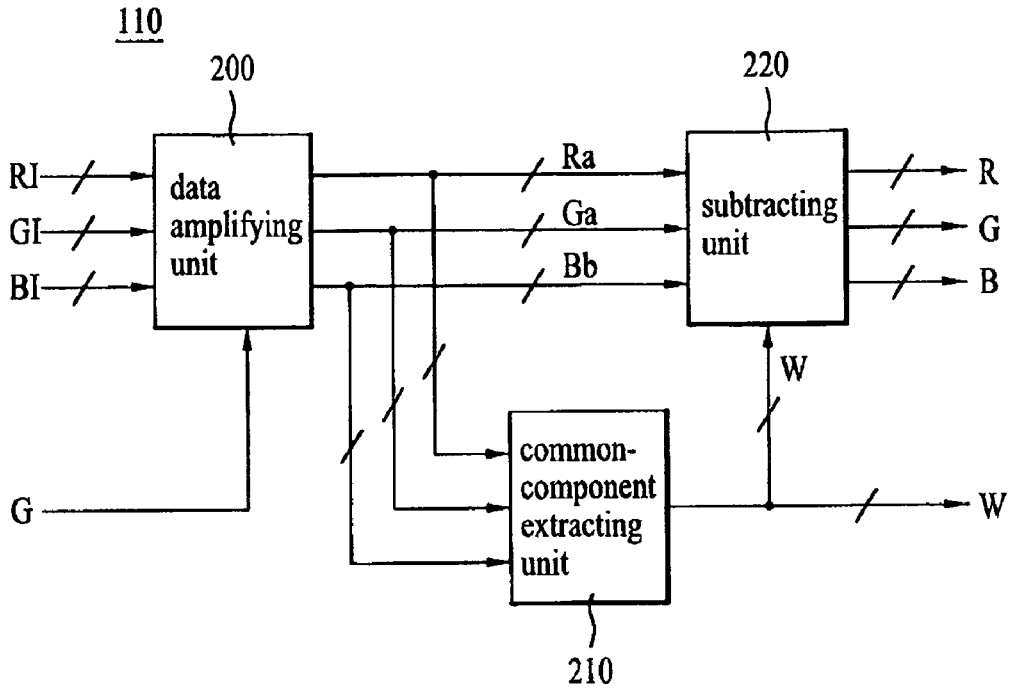
FIG. 6 is a block diagram of illustrating the data converter shown in FIG. 5.

FIG. 6 is a block diagram of illustrating the data converter shown in FIG. 5. As shown in FIG. 6, the data converter 110 includes a data amplifying unit 200, a common-component extracting unit 210, and a subtracting unit 220. The data amplifying unit 200 generates amplified data of three colors (Ra, Ga, Ba) by multiplying the input data of three colors (RI, GI, BI) inputted externally and a gain value (G) inputted externally, as shown in the following equation set 1.

$$Ra=RI\times G \quad \text{[equation set 1]}$$

$$Ga=GI\times G$$

$$Ba=BI\times G$$

The common-component extracting unit 210 extracts common components as white data (W) out of the amplified data of three colors (Ra, Ga, Ba) supplied from the data amplifying unit 200, and supplies the common components corresponding to white data (W) to the subtracting unit 220. Then, the subtracting unit 220 subtracts the white data (W) from the amplified data of three colors (Ra, Ga, Ba) supplied from the data amplifying unit 200, to thereby generate three-color data (RGB), as shown in the following equation set 2.

$$R=Ra-W \quad \text{[equation set 2]}$$

$$G=Ga-W$$

$$B=Ba-W$$

Subsequently, the data converter 110 supplies the white data (W) generated in the common-component extracting unit 210, and the four-color data (RGBW) of the three-color data generated in the subtracting unit 220 to the timing controller 108.

The timing controller 108, as shown in FIG. 5, arranges the four-color data (RGBW) supplied from the data converter 110 to the four-color data (Data) being appropriate for the driving of the LCD panel 102, and then supplies the arranged data to the data driver 104. Also, the timing controller 108 generates the data control signal (DCS) and the gate control signal (GCS) by using a main clock (DCLK), a data enable signal (DE), and horizontally and vertically synchronized signals (Hsync, Vsync) externally inputted thereto, and supplies the generated control signals to the data driver 104 and the gate driver 106, to thereby control the driving timing thereof.

The data driver 104 converts the four-color data (Data) arranged in the timing controller 108 into an analog video signal in accordance with the data control signal (DCS) supplied from the timing controller 108, and supplies the analog video signal for one horizontal line to the data lines (DL1 to DLm) by one horizontal period for supplying the scan pulse to the gate line (GL1 to GLn). That is, the data driver 104 selects a gamma voltage having a predetermined level based on a gray scale value of the four-color data (Data), and supplies the selected gamma voltage to the data lines (DL1 to DLm).

The gate driver 106 includes a shift register that sequentially generates the scan pulse. More specifically, a gate high pulse is generated in response to a gate start pulse and a gate shift clock of the gate control signal (GCS). The TFT is turned-on in response to the scan pulse.

Figure 7:
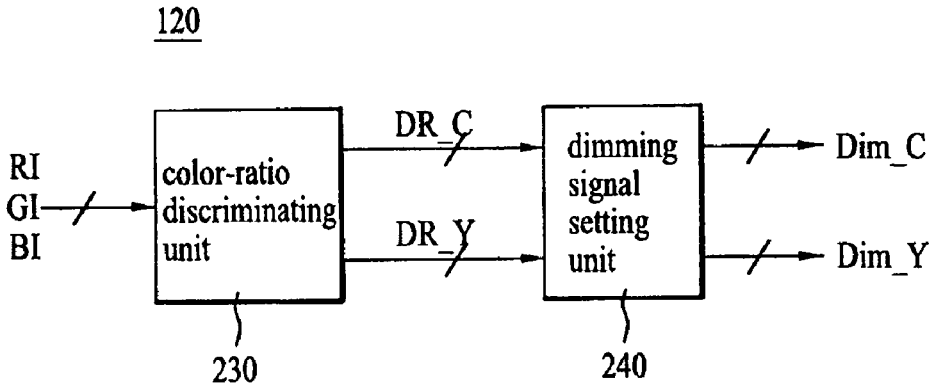
FIG. 7 is a block diagram of illustrating the LED controller shown in FIG. 5.

FIG. 7 is a block diagram of illustrating the LED controller shown in FIG. 5. As shown in FIG. 7, the LED controller 120 includes a color-ratio discriminating unit 230 and a dimming signal setting unit 240. The color-ratio discriminating unit 230 generates a cyan-color ratio signal (DR_C) based on a cyan-color ratio, and a yellow-color ratio signal (DR_Y) based on a yellow-color ratio from the three-color data of one frame (RI, GI, BI) inputted externally. More specifically, the cyan-color ratio signal (DR_C) is generated by the ratio of green and blue colors, as shown in the following equation 3.

$$\text{DR_C} \propto \frac{G}{R}:\frac{B}{R} \quad \text{[equation 3]}$$

Also, the yellow-color ratio signal (DR_Y) is generated by the ratio of green and red colors, as shown in the following equation 4.

$$\text{DR_Y} \propto \frac{G}{B}:\frac{R}{B} \quad \text{[equation 4]}$$

The dimming signal setting unit 240 sets a cyan-color dimming signal (Dim_C) corresponding to the cyan-color ratio signal (DR_C) supplied from the color-ratio discriminating unit 230, and supplies the generated cyan-color dimming signal (Dim_C) to the LED backlight unit 140. Also, the dimming signal setting unit 240 sets a yellow-color dimming signal (Dim_Y) corresponding to the yellow-color ratio signal (DR_Y) supplied from the color-ratio discriminating unit 230, and supplies the generated yellow-color dimming signal (Dim_Y) to the LED backlight unit 140. The data converter 110 and the LED controller 120 can be mounted on the timing controller 108.

The LED backlight unit 140, shown in FIG. 5, includes an LED array 162 having a plurality of LED groups that each have red, green, blue, cyan and yellow LEDs (R, G, B, C, Y), and an LED array driver 150 that drives the LED array 162. The LED array 162 is positioned opposite to the rear surface of the LCD panel 102. The LED array driver 150 generates red, green and blue light emission signals (VR, VG, VB) in accordance with the red, green and blue dimming signals that are set in correspondence with a white balance to thereby respectively drive the red, green and blue LEDs (R, G, B). Further, the LED array driver 150 generates a cyan light emission signal (VC) corresponding to the cyan-color dimming signal (Dim_C) supplied from the LED controller 120 to thereby drive the cyan LED (C). Furthermore, the LED array driver 150 generates a yellow light emission signal (VY) corresponding to the yellow-color dimming signal (Dim_Y) supplied from the LED controller 120 to thereby drive the yellow LED (Y).

The plurality of LED groups are arranged on the PCB in a matrix configuration to thereby uniformly provide the light to the entire rear surface of the LCD panel 102. The plurality of LED groups are each provided with a red LED (R) that emits red light; a green LED (G) that emits green light; a blue LED (B) that emits blue light; a cyan LED (C) that emits cyan light; and a yellow LED (Y) that emits yellow light. The red LED (R) emits red light in accordance with the red light emission signal (VR) supplied from the LED array driver 150. The green LED (G) emits green light in accordance with the green light emission signal (VG) supplied from the LED array driver 150. The blue LED (B) emits blue light in accordance with the blue light emission signal (VB) supplied from the LED array driver 150. The cyan LED (C) emits cyan light in accordance with the cyan light emission signal (VC) supplied from the LED array driver 150. The yellow LED (Y) emits yellow light in accordance with the yellow light emission signal (VY) supplied from the LED array driver 150.

The plurality of LED groups generate white light by mixing the red, green and blue light emitted from the red, green and blue LEDs (R, G, B), and provides the generated white light to the LCD panel 102. In addition, the plurality of LED groups emit cyan and yellow light from the cyan and yellow LEDs (C, Y), and provides the cyan and yellow light to the LCD panel 102. The backlight unit 140 can also include a plurality of optical sheets positioned between the LED array 162 and the LCD panel 102.

In the LCD device and the apparatus and method for driving the same according to the first embodiment of the invention, the white light is generated by the red, green and blue LEDs (R, G, B) while the cyan and yellow light are generated by the cyan and yellow LEDs (C, Y) in accordance with the ratio of cyan (C) and yellow (Y) colors from the input data (RI, GI, BI), thereby improving the color-realization ratio by using multi-primary light. Further, in the LCD device and the apparatus and method for driving the same according to the first embodiment of the invention, the LED groups of the LED array 162 may include a red LED, a green LED, a blue LED, and any two of cyan, yellow and magenta LEDs.

Figure 8:
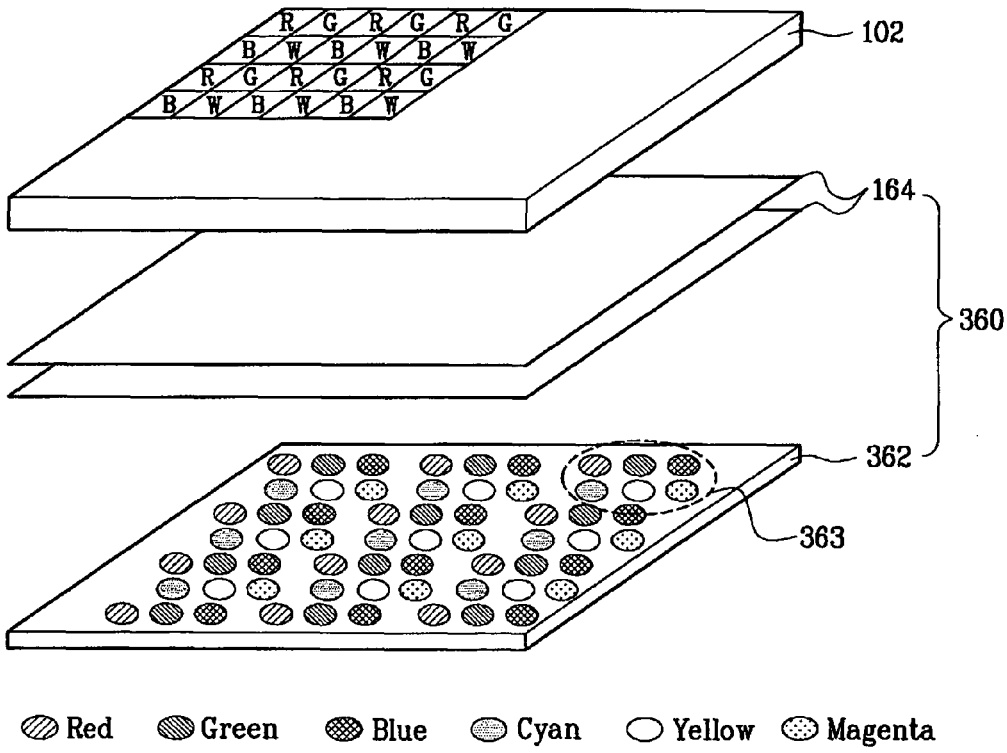
FIG. 8 is a perspective view of illustrating an LCD device according to the second embodiment of the invention.

FIG. 8 is a perspective view of illustrating an LCD device according to the second embodiment of the invention. Referring to FIG. 8, the LCD device according to the second embodiment of the present invention includes an LCD panel 102 that includes sub-pixels corresponding to four colors, and a backlight unit 360 which applies the light to the LCD panel 102 using LEDs of six colors. The LCD panel 102 in the LCD device according to the second embodiment is similar in structure to that of the first embodiment shown in FIG. 4, whereby the detailed explanation will be substituted by that of FIG. 4. In the LCD device according to the second embodiment of the invention, the white light formed by the mixture of red, green and blue light, the cyan light, the yellow light, and the magenta light is applied to the LCD panel 102 by using the LED groups provided with the LEDs of six colors, so that it is possible to improve the color realization ratio by use of multi-primary light The backlight unit 360 includes an LED array 362 having a plurality of LED groups, wherein each of the LED groups is provided with six colors of LEDs. The plurality of LED groups 363 are arranged on a PCB in a matrix configuration to thereby uniformly provide the light to the entire rear surface of the LCD panel 102. The plurality of LED groups 363 are provided with a red LED that emits a red light, a green LED that emits a green light, a blue LED that emits a blue light, a cyan LED that emits a cyan light, a yellow LED that emits a yellow light, and a magenta LED that emits a magenta light.

A plurality of optical sheets 164 are arranged on the LED array 362 to improve brightness and efficiency of the light provided to the LCD panel 102. The plurality of optical sheets 164 include at least one diffusion sheet (or diffusion plate) that diffuses the incident light from the LED array 362. The plurality of optical sheets can also include at least one prism sheet that changes the path of light diffused in the diffusion sheet toward the LCD panel 102 to improve light efficiency.

Figure 9:
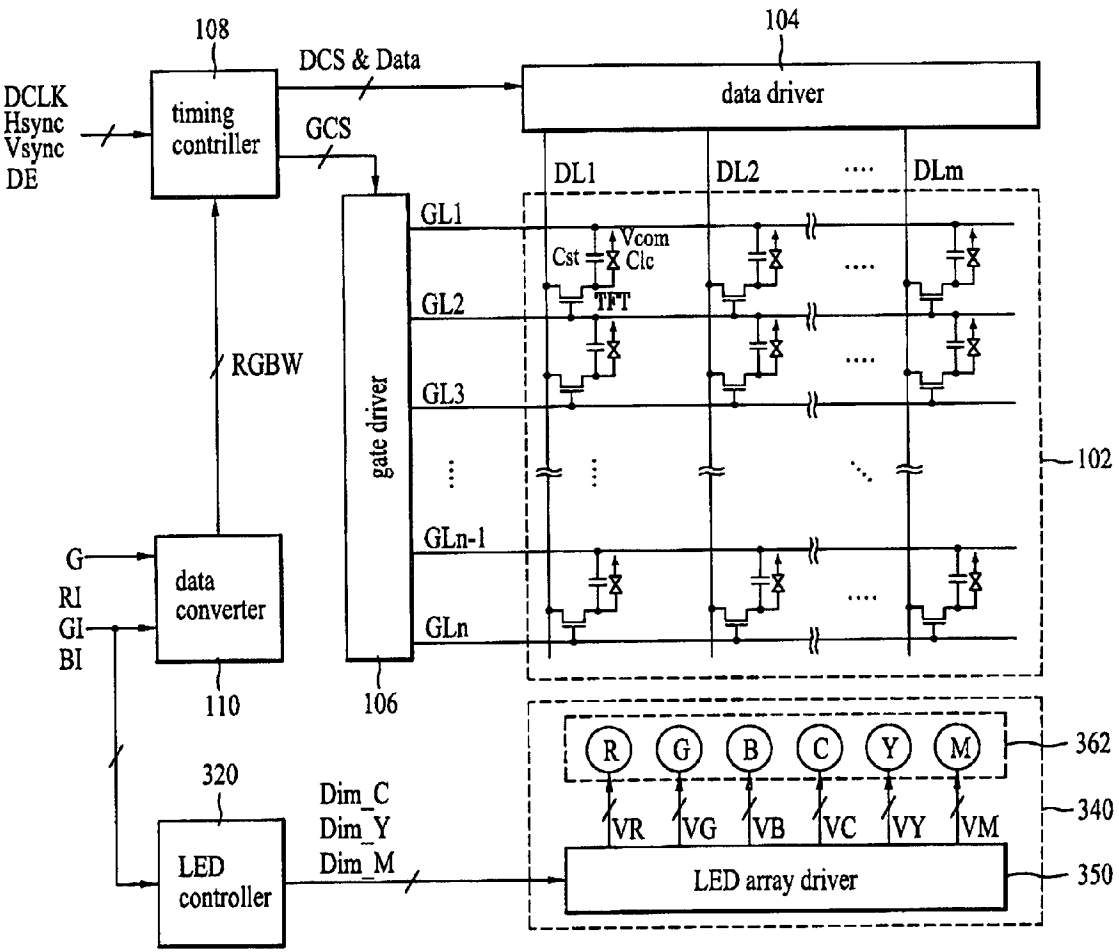
FIG. 9 is a schematic view of illustrating an LCD device and a driving apparatus thereof according to the second embodiment of the invention.

FIG. 9 is a schematic view of illustrating an LCD device and a driving apparatus thereof according to the second embodiment of the invention. Referring to FIG. 9 in association with FIG. 8, the LCD device and the driving apparatus according to the second embodiment of the invention includes an LCD panel 102 that includes: liquid crystal cells formed in respective sub-pixels of four colors defined by n gate lines (GL1 to GLn) and m data lines (DL1 to DLm); a data driver 104 that supplies a video signal to the data lines (DL1 to DLm); a gate driver 106 that supplies a scan pulse to the gate lines (GL1 to GLn); a data converter 110 that converts input data of three colors (RI, GI, BI) into input data of four colors (RGBW); a timing controller 108 that arranges the input data of four colors (RGBW) and supplies the arranged data to the data driver 104, controls the data driver 104 by generating a data control signal (DCS), and controls the gate driver 106 by generating a gate control signal (GCS); an LED backlight unit 340 having six colors of LEDs; and an LED controller 320 that controls the LED backlight unit 340 in accordance with the input data of three colors (RI, GI, BI).

Except the LED backlight unit 340 and the LED controller 320, the LCD device and the driving apparatus according to the second embodiment of the invention is similar in structure to the first embodiment of the invention, as shown in FIG. 5. Accordingly, the following explanation for the second embodiment of the invention will focus on the LED backlight unit 340 and the LED controller 320, and the other features of the LCD device according to the second embodiment of the invention are similar to those in the first embodiment.

Figure 10:
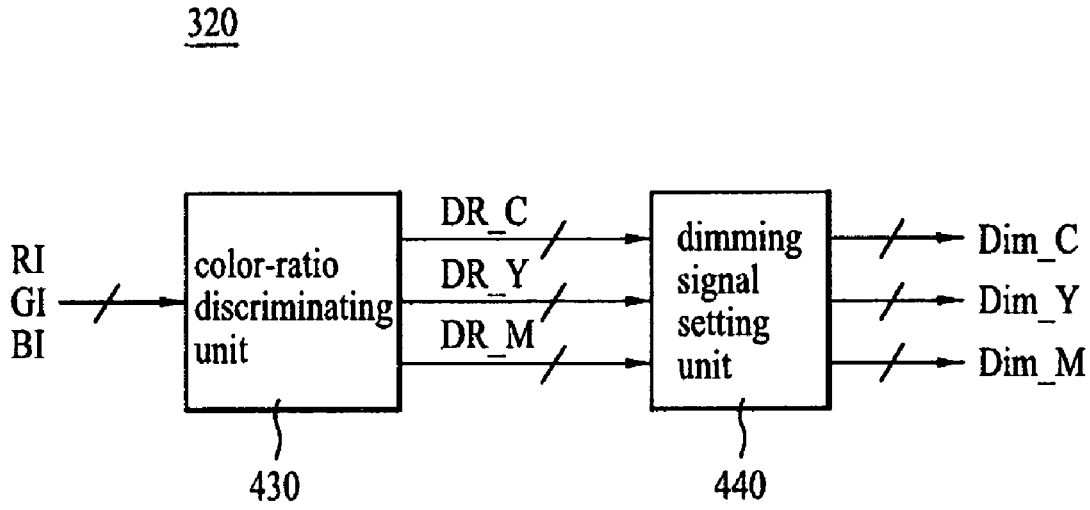
FIG. 10 is a block diagram of illustrating the LED controller shown in FIG. 9.

FIG. 10 is a block diagram of illustrating the LED controller shown in FIG. 9. As shown in FIG. 10, the LED controller 320 includes a color-ratio discriminating unit 430 and a dimming signal setting unit 440. The color-ratio discriminating unit 430 generates a cyan-color ratio signal (DR_C) based on a cyan-color ratio, a yellow-color ratio signal (DR_Y) based on a yellow-color ratio, and a magenta-color ratio signal (DR_M) based on a magenta-color ratio from the three-color data of one frame (RI, GI, BI) inputted externally. More specifically, the cyan-color ratio signal (DR_C) is generated by the ratio of green and blue colors, as shown in the above equation 3, and the yellow-color ratio signal (DR_Y) is generated by the ratio of green and red colors, as shown in the above equation 4. Also, the magenta-color ratio signal (DR_M) is generated by the ratio of red and blue colors, as shown in the following equation 5.

$$\mathrm{DR_M} \propto \frac{R}{G} : \frac{B}{G} \qquad \text{[equation 5]}$$

The dimming signal setting unit 440 sets a cyan-color dimming signal (Dim_C) corresponding to the cyan-color ratio signal (DR_C) supplied from the color-ratio discriminating unit 430, and then supplies the generated cyan-color dimming signal (Dim_C) to the LED backlight unit 340. Further, the dimming signal setting unit 440 sets a yellow-color dimming signal (Dim_Y) corresponding to the yellow-color ratio signal (DR_Y) supplied from the color-ratio discriminating unit 430, and then supplies the generated yellow-color dimming signal (Dim_Y) to the LED backlight unit 340. Furthermore, the dimming signal setting unit 440 sets a magenta-color dimming signal (Dim_M) corresponding to the magenta-color ratio signal (DR_M) supplied from the color-ratio discrimination unit 430, and then supplies the generated magenta-color dimming signal (Dim_M) to the LED backlight unit 340.

The backlight unit 340 shown in FIG. 9 includes an LED array 362 that includes: a plurality of LED groups that each have red, green, blue, cyan, yellow and magenta LEDs (R, G, B, C, Y, M); and an LED array driver 350 that drives the LED array 362. The LED array 362 is positioned in opposite to the rear surface of the LCD panel 102. The backlight unit 340 also includes a plurality of optical sheets provided between the LED array 362 and the LCD panel 102. The LED array driver 350 generates red, green and blue light emission signals (VR, VG, VB) in accordance with the red, green and blue dimming signals that are set in correspondence with a white balance to thereby respectively drive the red, green and blue LEDs (R, G, B). More specifically, the LED array driver 350 generates a cyan light emission signal (VC) corresponding to the cyan-color dimming signal (Dim_C) supplied from the LED controller 320 to thereby drive the cyan LED (C). Further, the LED array driver 350 generates a yellow light emission signal (VY) corresponding to the yellow-color dimming signal (Dim_Y) supplied from the LED controller 320 to thereby drive the yellow LED (Y). Furthermore, the LED array driver 350 generates a magenta light emission signal (VM) corresponding to the magenta-color dimming signal (Dim_M) supplied from the LED controller 320 to thereby drive the magenta LED (M).

The plurality of LED groups are arranged on a printed circuit board (PCB) in the matrix configuration to thereby uniformly provide light to the entire rear surface of the LCD panel 102. More specifically, each of the plurality of LED groups is provided with a red LED (R) that emits red light, a green LED (G) that emits green light, a blue LED (B) that emits blue light, a cyan LED (C) that emits cyan light, a yellow LED (Y) that emits yellow light; and a magenta LED (M) that emits magenta light. The red LED (R) emits the red light in accordance with the red light emission signal (VR) supplied from the LED array driver 350. The green LED (G) emits the green light in accordance with the green light emission signal (VG) supplied from the LED array driver 350. The blue LED (B) emits the blue light in accordance with the blue light emission signal (VB) supplied from the LED array driver 350. The cyan LED (C) emits the cyan light in accordance with the cyan light emission signal (VC) supplied from the LED array driver 350. The yellow LED (Y) emits the yellow light in accordance with the yellow light emission signal (VY) supplied from the LED array driver 350. The magenta LED (M) emits the magenta light in accordance with the magenta light emission signal (VM) supplied from the LED array driver 350.

The plurality of LED groups generate the white light by mixing the red, green and blue light respectively emitted from the red, green and blue LEDs, and provide the generated white light to the LCD panel 102. In addition, the plurality of LED groups apply the cyan, yellow and magenta light generated from the cyan, yellow and magenta LEDs (C, Y, M) to the LCD panel 102. In the LCD device and the apparatus and method for driving the same according to the second embodiment of the invention, white light is generated for the LCD panel 102 by using red, green and blue LEDs (R, G, B) while cyan, yellow and magenta light is applied to the LCD panel 102 by driving the cyan, yellow and magenta LEDs (C, Y, M) in accordance with the ratio of cyan (C), yellow (Y) and magenta (M) colors from the input data (RI, GI, BI), thereby improving the color-realization ratio by using multi-primary light.

In the LCD device and the apparatus and method for driving the same according to embodiments of the invention, white light is applied to the LCD panel by using the light of red, green and blue LEDs. Simultaneously, the light of at least two of cyan, yellow and magenta colors generated from cyan, yellow and magenta LEDs in accordance with the ratio of at least two colors of the cyan, yellow and magenta colors in the input data is applied to the LCD panel, to thereby improve the color realization ratio by using multi-primary light.

It will be apparent to those skilled in the art that various modifications and variations can be made in embodiments of the invention without departing from the spirit or scope of the inventions. Thus, it is intended that the invention covers the modifications and variations of this invention provided they come within the scope of the appended claims and their equivalents.

What is claimed is:

1. An apparatus for driving a liquid crystal display device having four colors of sub-pixels comprising:

a data converter that converts input data of three colors inputted externally into four-color data;

a data driver that converts the four-color data into video signals and then supplies the video signals to the sub-pixels;

a gate driver that supplies a scan pulse to each sub-pixel;

a timing controller that arranges the four-color data supplied from the data converter, and then supplies the arranged four-color data to the data driver while controlling the data driver and the gate driver;

a backlight unit that provides light to the liquid crystal display panel using at least five colors of light emitting diodes; and a light emitting diode controller that controls the backlight unit in accordance with the three-color input data;

wherein the data converter includes:

1) a data amplifying unit that generates three-color amplified data by multiplying the three-color input data and a gain value inputted externally;

2) a common-component extracting unit that extracts common components as white data from the three-color amplified data; and 3) a subtracting unit that subtracts the white data from the three-color amplified data, to thereby generate first to third color data, wherein the four-color data corresponds to the first to third color data and the white data;

wherein the light emitting diode controller includes:

1) a color-ratio discriminating unit that generates at least two of cyan, yellow and magenta color ratio signals in accordance with the ratio of at least two colors of cyan, yellow and magenta colors from the three-color input data; and 2) a dimming signal generating unit that generates at least two light emission signals corresponding to the at least two ratio signals;

wherein the cyan-color ratio signal is generated by the ratio of green/red to blue/red, the yellow-color ratio signal is generated by the ratio of green/blue to red/blue, and the magenta-color ratio signal is generated by the ratio of red/green to blue/green.

2. The apparatus of claim 1, wherein the backlight unit includes:

a light emitting diode array with a plurality of light emitting diode groups that each group has red, green and blue light emitting diodes, and at least two of cyan, yellow and magenta light emitting diodes; and a light emitting diode array driver that drives the red, green and blue light emitting diodes in accordance with the input data of three colors, and also drives at least two of the cyan, yellow and magenta light emitting diodes in accordance with the at least two color ratio signals.

3. A method for driving a liquid crystal display device having a light emitting diode panel provided with four colors of sub-pixels comprising:

converting input data of three colors inputted externally into four-color data;

supplying a scan pulse to each sub-pixel;

converting the four-color data into video signals, and then supplying the video signals to the sub-pixels in synchronization with the scan pulse; and driving a backlight unit having light emitting diodes of at least five colors to provide light to a liquid crystal display panel;

wherein the converting input data of three colors inputted externally into four-color data includes:

1) generating three-color amplified data by multiplying the three-color input data and a gain value inputted externally;

2)extracting common components as white data from the three-color amplified data; and 3) subtracting the white data from the three-color amplified data, to thereby generate first to third color data, wherein the four-color data corresponds to the first to third color data, and the white data;

wherein the controlling the backlight unit includes:

1) generating at least two of cyan, yellow and magenta color ratio signals in accordance with the ratio of at least two colors of cyan, yellow and magenta colors from the three-color input data;

2) generating at least two light emission signals corresponding to the at least two ratio signals; and 3) driving the red, green and blue light emitting diodes in accordance with the set three-color light emission signal, and driving at least two of the cyan, yellow and magenta light emitting diodes in accordance with the ratio signal of at least two colors;

wherein the cyan-color ratio signal is generated by the ratio of green/red to blue/red, the yellow-color ratio signal is generated by the ratio of green/blue to red/blue, and the magenta-color ratio signal is generated by the ratio of red/green to blue/green.

4. The method of claim 3, further comprising:

controlling the backlight unit in accordance with the first to third color data.

* * * * *